US005226831A

United States Patent [19]

Horiuchi

[11] Patent Number: 5,226,831

[45] Date of Patent: Jul. 13, 1993

[54] FIXING STRUCTURE OF A FLAT CABLE CONNECTING PORTION IN A ROTARY CONNECTOR

[75] Inventor: Naoaki Horiuchi, Tokyo, Japan

[73] Assignee: The Furukawa Electric Co., Ltd., Tokyo, Japan

[21] Appl. No.: 931,825

[22] Filed: Aug. 18, 1992

[30] Foreign Application Priority Data

Aug. 21, 1991 [JP] Japan ..... 3-066093

[51] Int. Cl.[5] ..... H01R 39/02

[52] U.S. Cl. ..... 439/164; 439/15

[58] Field of Search ..... 439/15, 169

[56] References Cited

U.S. PATENT DOCUMENTS

| | | | |
|---|---|---|---|
| 4,744,763 | 5/1988 | Suzuki et al. | 439/164 X |
| 5,032,084 | 7/1991 | Schauer | 439/15 |
| 5,151,042 | 9/1992 | Okada | 439/164 |

*Primary Examiner*—Eugene F. Desmond

*Attorney, Agent, or Firm*—Frishauf, Holtz, Goodman & Woodward

[57] ABSTRACT

A fixing structure of a flat cable connecting portion in a rotary connector, wherein the connecting portion is provided on each end of a flat cable which is comprised of a plurality of conductors arranged in parallel and insulator-covered and which is housed in the form of a coil in a circular space formed by a pair of cases which are installed so that they are allowed to rotate against each other, at least one connecting portion of said flat cable being attached to the connection housing provided on the case and the connecting portion being fixed to the connection housing by a fixing component mounted on the case. The connecting portion of the flat cable is provided with an engaging section which engages with the connection housing, and the fixing component consists of integral parts of a tongue piece, which is inserted in a gap provided in the case or connecting portion, locking hooks engaged with the case, and the reversion checking component which acts as a check on the flat cable's reversing in the vicinity of the connecting portion of the flat cable.

5 Claims, 4 Drawing Sheets

FIXING STRUCTURE OF A FLAT CABLE CONNECTING PORTION IN A ROTARY CONNECTOR

BACKGROUND OF THE INVENTION

1. Field of the Invention

The present invention relates to a fixing structure of a flat cable connecting portion in a rotary connector.

2. Description of Related Art

A rotary connector has a flat cable, which is a flexible, belt-shaped electric wire and which is wound into a coil to be housed in a annular space formed by a rotary case and a fixed case. These cases are allowed to perform relative rotation between them, a connecting portion on one end of the flat cable being mounted on the fixed case, while a connecting portion on the other end being mounted on the rotary case. The relative rotation between the cases is made possible by the flat cable windable or unwindable as the foregoing rotary case rotates. In this case, the flat cable is a belt-shaped transmission line comprised of a plurality of electrical conductors (not shown) covered with an insulator.

In such a rotary connector, the connecting portions of the foregoing flat cable are fitted in connection housings provided in the respective cases, then fixed to the connection housings by fixing components attached to the respective cases. Here, the rotary connector allows the relative rotation between the cases by the coiled flat cable's tightening or loosening as described above. For this reason, various types of stress such as tension and compression cuts on the connecting portions as the coiling flat cable is wound or unwound in the rotary connector.

Therefore, it is necessary to securely fix the connecting portions of the flat cable to the cases. Conventionally, to fix the connecting portions of the cases by installing fixing components on the cases, the fixing components are fixed to the cases by, for example, a plurality of rivets, or by providing the fixing components with locking hooks whereby the fixing components are attached to the cases.

When the fixing components are riveted to the cases with rivets to mount the fixing components to the cases, the number of processes for assembling the rotary connector increases, raising a problem of poor work efficiency.

On the other hand, when the fixing components are installed to the cases by locking hooks, the installation can be completed readily; therefore, it is easy to install and also easy to check for proper engagement due to a click which is felt when the hooks engage with the case. However, the locking hooks may disengage from the cases during the use of the rotary connector, and the installation may not necessarily be secure.

In addition, the rotary connector is normally provided with components for preventing reversion in the vicinity of the connecting portions of the flat cable, which components are called end supports and have function to prevent buckling causable by the flat cable's reversing when the cases rotate near a limit of the winding or unwinding of the coiling flat cable. For this reason, the rotary connector required two types of components, i.e., the components for preventing reversion and the fixing components, adding to the number of parts with consequent inefficiency in the aspect of parts control.

SUMMARY OF THE INVENTION

An object of the present invention is to provide a fixing structure for a flat cable connecting portion in a rotary connector which permits easy installation of the flat cable connecting portions to cases and which has a minimized number of required parts.

Another object of the present invention is to provide a fixing structure for a flat cable connecting portion in a rotary connector which assures positive fixing of the flat cable connecting assemblies onto the cases.

To fulfill the above-mentioned objects, according to the present invention, in a fixing structure of a flat cable connecting portion in a rotary connector, wherein the connecting portion is provided on each end of a flat cable, which is comprised of a plurality of conductors arranged in parallel and insulator-covered and which is housed in the form of a coil in a annular space in a case formed by a pair of case which are installed so that they are allowed to rotate relative to each other, at least one connecting portion of the flat cable being attached to a connection housing provided on the case and the connecting portion being fixed to the connection housing by a fixing component mounted on the case; the connecting portion of the flat cable being provided with an engaging section which engages with the connection housing, and the fixing component consisting of a tongue piece, which is inserted in a gap provided in the case or connecting portion, locking hooks engaged with the case, and a reversion preventing component, which prevents the flat cable from reversing in the vicinity of the connecting portion, are all unified into one piece.

According to the fixing structure of the flat cable connecting portion in accordance with the present invention, the connecting portion at an end of the flat cable is easily fixed through the concave-convex engagement between the engaging section and the connection housing. The fixing component is attached to the case by the locking hook, and the connecting portion of the flat cable is further firmly fixed to the case by the tongue piece.

At this time, if the connecting portion of the flat cable is not securely inserted in the connection housing, the fixing component cannot be attached to the case; therefore, the connecting portion mounted on the connection housing can be checked for proper fixing condition by knowing the installed condition of the fixing component. In addition, since the fixing component is integral with the reverse preventing component, the required number of parts can be reduced, permitting easier management of parts.

The foregoing and other objects of the present invention, characteristics, and advantages will become more apparent from the following detailed description taken in connection with the accompanying drawings.

DETAILED DESCRIPTION OF THE PREFERRED EMBODIMENTS

An embodiment of the present invention will now be described in detail with reference to FIG. 1 through FIG. 5.

Figure 2:
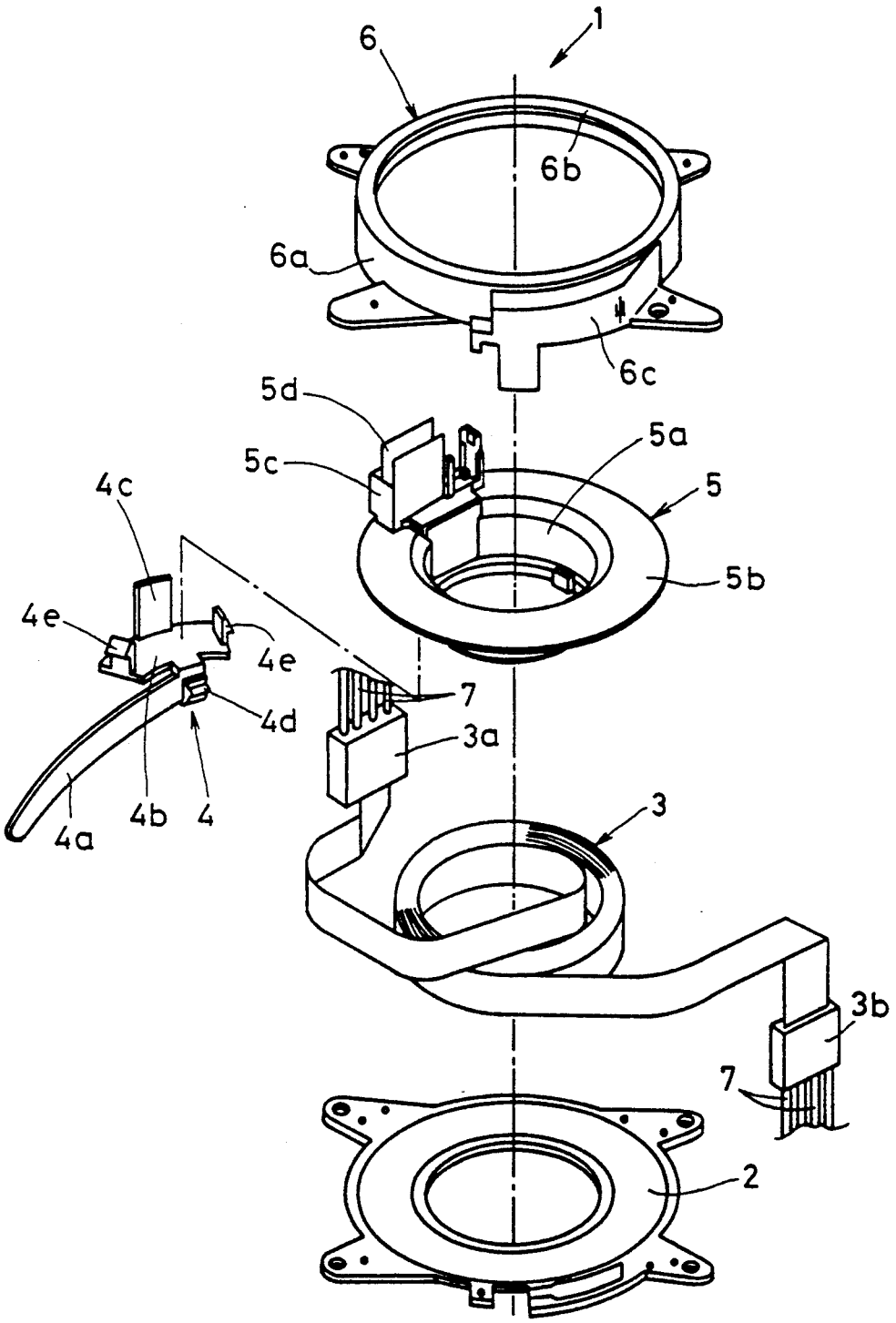
FIG. 2 is an exploded perspective view which shows the components of the rotary connector of FIG. 1.

As shown in FIG. 2, a rotary connector 1 is comprised of a base plate 2, a flat cable 3 which is wound into a coil, a fixing component 4, an inner cylindrical case 5, and an outer cylindrical case 6 in the order they are listed. The flat cable 3 is contained in a circular space formed by the base plate 2 and cases 5 and 6 so that the coiled flat cable is allowed to tighten or loosen, the base plate 2 and the outer cylindrical case 6 forming a fixed case, while the inner cylindrical case 5 being a rotary case.

The inner end and the outer end of the coiled flat cable 3 are provided with a connecting portion 3*a* and a connecting portion 3*b*, respectively. At the connecting portions 3*a* and 3*b*, the conductors (not shown) of the flat cable 3 are connected with external electric wires 7, the connecting assemblies being molded with electrically insulating synthetic resin. A plurality of external electric wires 7 extend from these connecting assemblies 3*a* and 3*b* as illustrated. Also, the connecting assemblies 3*a* and 3*b* are provided with concave sections 3*c* and 3*d* (the concave section 3*d* is not shown) which engage with locking hooks 5*h* and 6*h* (the locking hook 6*h* is not illustrated) formed in connection housings 5*c* and 6*c*.

Figure 3:
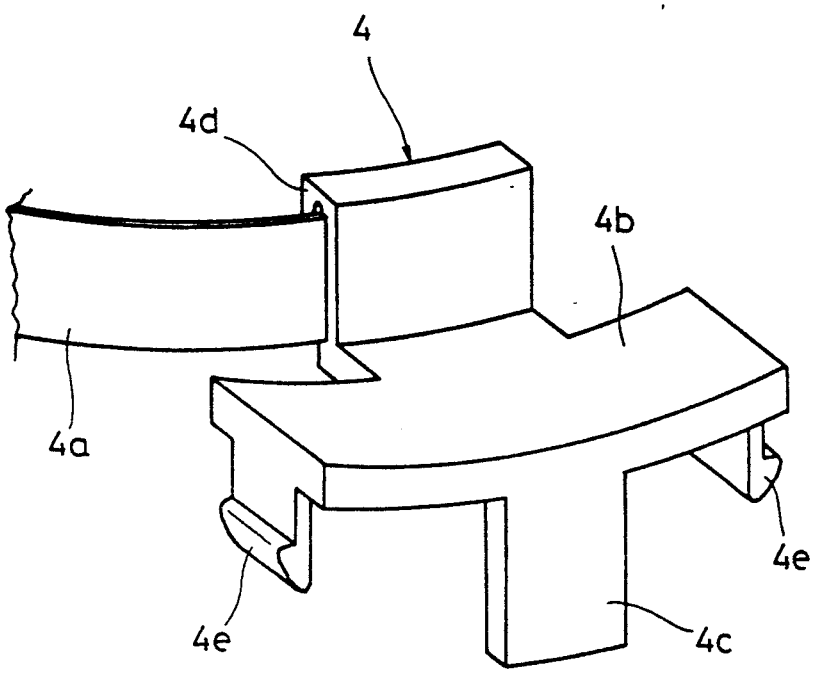
FIG. 3 is a perspective view of a fixing component of the rotary connector.

As shown in FIG. 3, the fixing component 4 is a synthetic-resin component made up of an end support 4*a*, mounting section 4*b*, and a securing tongue piece 4*c* which are all molded into one piece, the end support 4*a* being provided with an insertion piece 4*d*.

The end support 4*a* is a reversion preventing component which prevents the inner end and the outer end of the flat cable 3 from reversing, which causes buckling, when the flat cable 3 tightens or loosens nearly to the limit.

The mounting section 4*b* is shaped into an approximate arc plate to match the shape of the inner cylindrical case 5, locking hooks 4*e* and 4*e* projecting from both ends. The securing tongue piece 4*c* is inserted in a gap 5*f*(refer to FIG. 1), which will be described later, of the connection housing 5*c* to secure the fixing component 4 installed in the inner cylindrical case 5. The gap on the side of the connection housing 6*c*, in which the securing tongue 4*c* is inserted, is not illustrated.

When installing the fixing component 4 on either one of the cases, the inserting piece 4*d* is inserted in an insertion gap 5*g*(refer to FIG. 1), which will be discussed later, of the inner cylindrical case 5, stepping over the flat cable 3.

Each locking hook 4*e* engages with each of the engaging sections (not shown) formed on the connection housings 5*c* and 6*c*, which will be discussed later, of the inner cylindrical case 5 or the outer cylindrical case 6, and the fixing component 4 is fixed on the connection housing 5*c* or the connection housing 6*c*.

Figure 1:
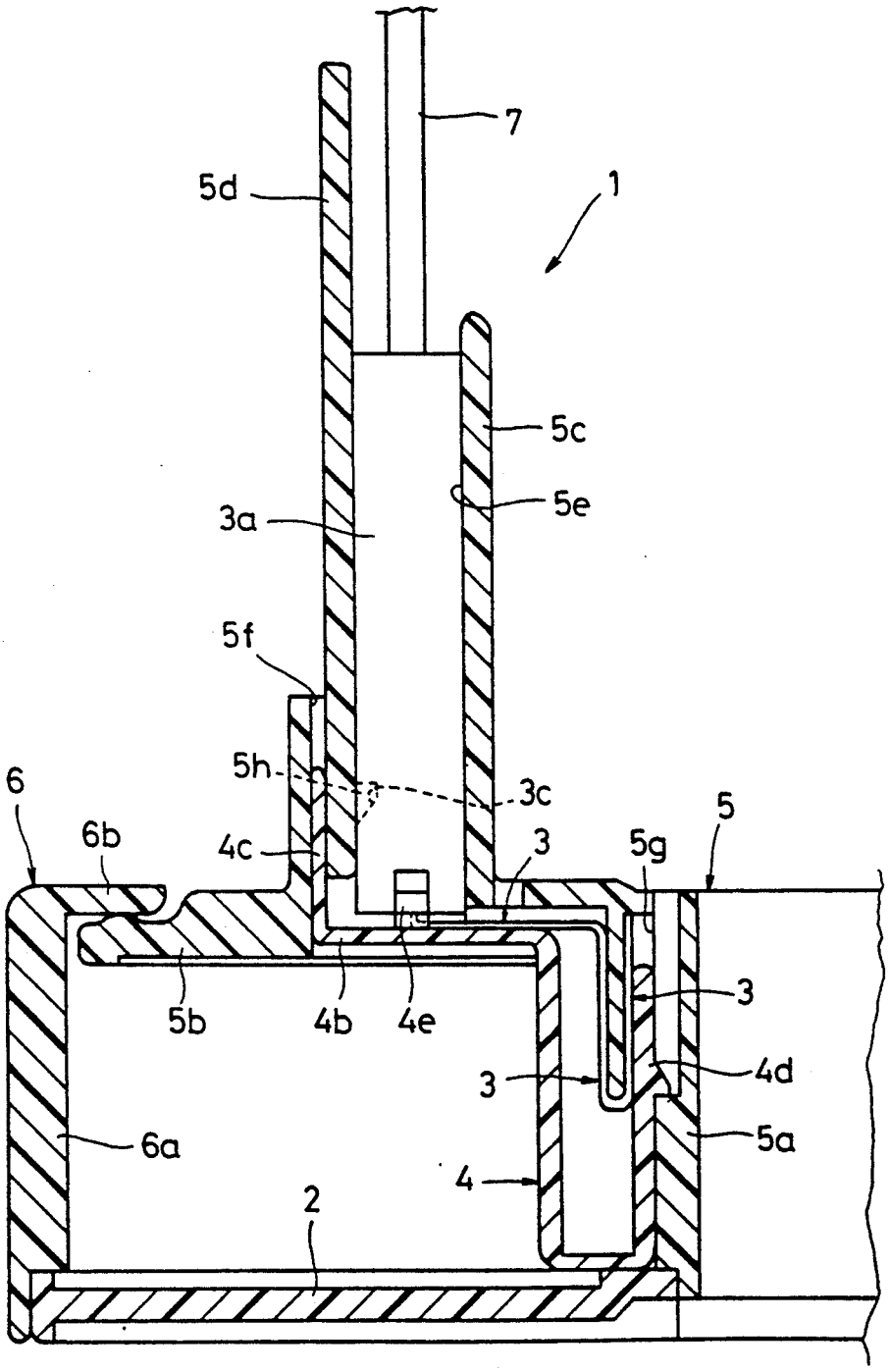
FIG. 1 is a sectional front view which shows a major section of a rotary connector, illustrating an embodiment related to a fixing structure in accordance with the present invention.

As shown in FIG. 2, the inner cylindrical case 5 has an integral part, i.e., an upper flange 5*b* which is located on an inner cylindrical shaft 5*a* and which extends outward in the radius direction, the connection housing 5*c* being formed as an integral part of the upper flange 5*b*. As shown in FIG. 1, the connection housing 5*c* is divided into an insertion section 5*e* and a gap 5*f* by a partitioning plate 5*d*; the connecting portion 3*a* of the flat cable 3 is inserted into the insertion section 5*e*, while the securing tongue piece 4*c* of the fixing component 4 is inserted into the gap 5*f*. Further, the inner cylindrical shaft 5*a* is provided with the insertion gap 5*g* into which the insertion piece 4*d* of the fixing component 4 is inserted. At the side of the insertion section 5*e* of the partitioning plate 5*d*, there is provided with the locking hook 5*h* which engages with the concave section 3*c* formed in the connecting portion 3*a* as illustrated.

The outer cylindrical case 6 has a flange 6*b* extending inward in the radius direction from the top of a side wall 6*a*; and it also has the connection housing 6*c* projecting on one side. As shown in FIG. 1, the tip of the flange 6*b* is brought in contact with the tip of the upper flange 5*b* to install the outer cylindrical case 6 to the inner cylindrical case 5.

In the rotary connector 1 configured as described above, the present invention is characterized by a fixing structure for fixing the connecting portions 3*a* and 3*b* of the flat cable 3 to the cases 5 and 6, respectively. For instance, the connecting portion 3*a* is fixed to the connection housing 5*c* of the inner cylindrical case 5 as set forth below.

First, the connecting portion 3*a* provided on the inner end of the flat cable 3 is inserted from below into the connection housing 5*c* of the inner cylindrical case 5, and a plurality of external electric wires 7 are drawn up above the connection housing 5*c*. At this time, the connecting portion 3*a* is pushed up until the locking hook 5*h* of the connection housing 5*c* engages with the concave section 3*c*. If the assembly 3*a* is not pushed up sufficiently, the connecting portion 3*a* projects from the connection housing 5*c*, preventing the installation of the fixing component 4.

Next, as shown in FIG. 2, the insertion piece 4*d* is inserted into the insertion gap 5*g* and the securing tongue piece 4*c* into the gap 5*f* from below the upper flange 5*b*, and the locking hooks 4*e* and 4*e* are engaged with the foregoing engaging sections formed on the connection housing 5*c* to mount the fixing component 4 to the connection housing 5*c*.

Thus, the locking hook 5*h* of the connection housing 5*c* engages with the concave section 3*c* and the fixing component 4 is also installed beneath the connection housing 5*c*; therefore, the connecting portion 3*a* will not be pulled off the connection housing 5*c* even when the flat cable 3 tightens or loosens as the rotary connector 1 operates. In addition, the fixing component 4 is installed on the connection housing 5*c* by the locking hooks 4*e* and 4*e* and the securing tongue 4*c* is inserted into the gap 5*f*; therefore, the fixing component 4 will not be loosened even if it is subjected to an external force, thus ensuring stable installed condition.

Also, the connecting portion 3*a* gives a click when the locking hook 5*h* of the connection housing 5*c* engages with the concave section 3*c*, making it possible to know that the connecting portion 3*a* has been properly inserted into the connection housing 5*c*. In addition, if the connecting portion 3*a* is inadequately inserted into the connection housing 5*c*, it prevents the locking hooks 4*e* and 4*e* from being engaged with the connection housing 5*c* or the securing tongue piece 4*c* from being inserted into the gap 5*f*, eventually preventing the fixing component 4 from being mounted on the inner cylindrical case 5. This makes it possible to check for proper insertion of the connecting portion 3a into the connection housing 5c by knowing whether the fixing component 4 can be mounted on the inner cylindrical case 5. Thus, improper installation of the connecting portion 3a can be prevented.

The connecting portion 3b can be fixed on the connection housing 6c of the outer cylindrical case 6 in the same manner as that for the connecting portion 3a.

Figure 4:
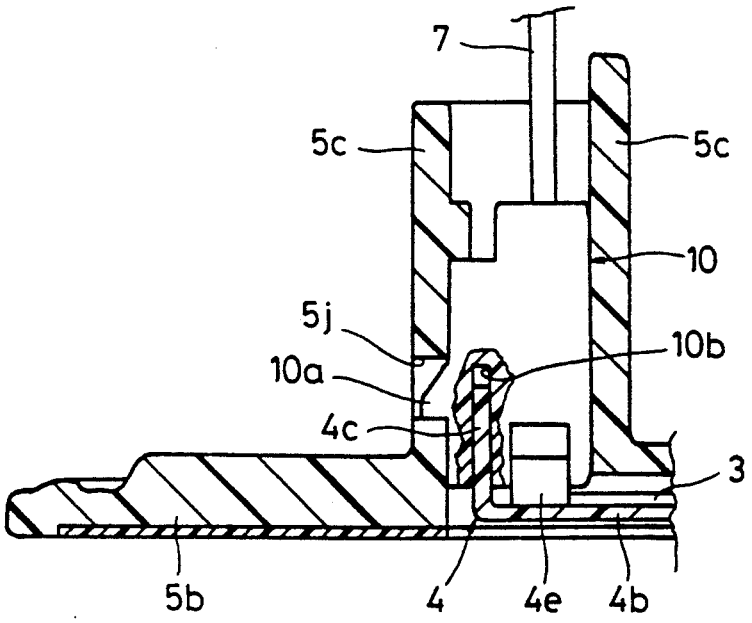
FIG. 4 is a front view of a cross-section of a major section, illustrating a modification of the fixing structure in accordance with the present invention.

Further, the fixing structure of the connecting portion of the flat cable in accordance with the present invention is not limited to the embodiment described above, but it may also be the fixing structure shown in FIG. 4.

As illustrated, a connecting portion 10 on one end of the flat cable 3 is provided with a locking hook 10a and an insertion groove 10b into which the securing tongue piece 4c of the fixing component 4 is inserted, and the connection housing 5c is provided with an engaging section 5j with which the locking hook 10a is engaged. Further, a plurality of external electric wires 7, which are connected to conductors (not shown) of the flat cable 3, extend from the connecting portion 10.

The connecting portion 10 of the flat cable 3 is inserted from below the connection housing 5c, the external electric wires 7 are drawn out upward, then the fixing component 4 is installed to the connection housing 5c from below.

This causes the locking hook 10a of the connecting portion 10 to engage with the engaging section 5j of the connection housing 5c, adding to the resistance to downward pulling force. In the fixing component 4, the locking hooks 4e and 4e engage with the foregoing engaging section of the connection housing 5c, and the securing tongue piece 4c is inserted into the insertion groove 10b, thereby securely fixing the fixing component to the inner cylindrical case 5 in the same way as described above.

Another embodiment of the fixing structure in the connection housing 5c on the side of the inner cylindrical case 5 will now be explained based on the rotary connector 1 shown in FIG. 5. In this embodiment, the rotary connector 1 is slightly different in structure from the one shown in FIG. 1, but it retains the same basic structure. For this reason, the sections corresponding to the sections of the rotary connector 1 shown in FIG. 1 are assigned the matching signs for the purpose of explanation.

In the flat cable 3, a concave groove 11a is formed widthwise at the center in the lower position of the connecting portion 11, and an engaging concave section 11b, which extends downward, is provided at the center of the concave groove 11a. In addition, a plurality of external electric wires 7 connected to the conductors (not shown) of the flat cable 3 extend from the connecting portion 11.

The connection housing 5c is provided with a locking convex column 51 which extends vertically at the lower part of the partitioning plate 5d and which has a locking hook 5k at its bottom, and a locking opening 5m which is located in adjacent to the locking convex column 51 and which is connected to the gap 5f.

Further, in the fixing component 4, the locking hook 4f, which engages with the bottom of the locking opening 5m, is provided at the end of the securing tongue piece 4c.

The connecting portion 11 of the flat cable 3 is inserted into the connection housing 5c from below, a plurality of the external electric wires 7 are drawn out upward, and the fixing component 4 is installed to the connection housing 5c from below.

Figure 5:
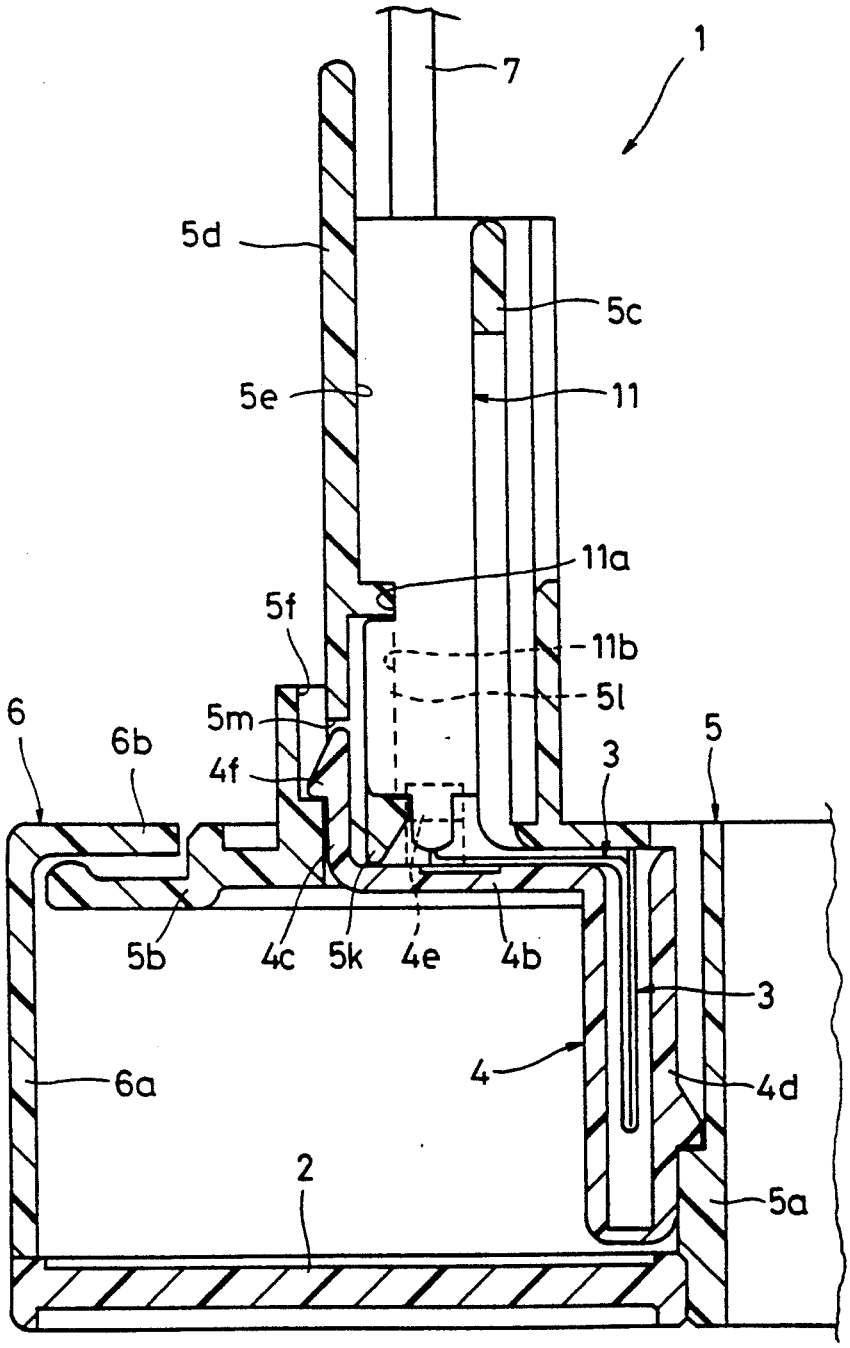
FIG. 5 is a cross-sectional front view of a major section of the rotary connector, illustrating another embodiment of the present invention.

Thus, in the rotary connector 1 shown in FIG. 5, the engaging concave section 11b of the connecting portion 11 engages with the locking convex column 51, and the locking hook 4f engages with the bottom of the locking opening 5m, thereby securely fixing the connecting portion 11 to the connection housing 5c.

What is claimed is:

1. A fixing structure of a flat cable connecting portion in a rotary connector, wherein a connecting portion is provided on each end of a flat cable, which is comprised of a plurality of conductors arranged in parallel and insulator-coated and which is housed in the form of a coil in a circular space of a case defined by a pair of case portions which are coupled together so that they are rotatable relative to each other, at least one connecting portion of said flat cable being joined to a connection housing provided on the case and said connecting portion being fixed to the connection housing by a fixing component mounted on the case;

said fixing structure of a flat cable connecting portion in a rotary connector being characterized in that the connecting portion of said flat cable is provided with an engaging section which engages with said connection housing, and that the fixing component is provided with integral parts of a tongue piece, which is inserted into a gap provided in said case or connecting portion, locking hooks engaging with said case, and a reversion preventing component which prevents the flat cable from reversing in the vicinity of the connecting portion.

2. The fixing structure of a flat cable connecting portion in a rotary connector according to claim 1, wherein the engaging section provided on the connecting portion of the said flat cable comprises a concave section which engages with locking hooks provided on said connection housing.

3. The fixing structure of a flat cable connecting portion in a rotary connector according to claim 1, wherein said fixing component comprises said tongue piece, said locking hooks and said reversion preventing component which are molded into one piece and which are provided on a mounting section located in said circular space of said case.

4. The fixing structure of a flat cable connecting portion in a rotary connector according to claim 1, wherein said flat cable connecting portion comprises a connecting section with which the conductors are connected to external electric wires and which is molded into a given shape with synthetic resin.

5. The fixing structure of a flat cable connecting portion in a rotary connector according to claim 3, wherein said fixing component has an engaging hook provided on the end of the tongue piece, the engaging hook being to engageable with a locking opening formed in said connection housing.

* * * * *